US006867553B2

(12) United States Patent
Nerone et al.

(10) Patent No.: US 6,867,553 B2
(45) Date of Patent: Mar. 15, 2005

(54) CONTINUOUS MODE VOLTAGE FED INVERTER

(75) Inventors: Louis R. Nerone, Brecksville, OH (US); James D. Mieskoski, Seven Hills, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/417,023

(22) Filed: Apr. 16, 2003

(65) Prior Publication Data

US 2004/0207335 A1 Oct. 21, 2004

(51) Int. Cl.[7] ..... H05B 37/02

(52) U.S. Cl. ..... 315/224; 315/242; 315/307; 315/247; 315/DIG. 4

(58) Field of Search ..... 315/224, 247, 315/244, DIG. 4, 307, 308, 291, 225, DIG. 5, 219

(56) References Cited

U.S. PATENT DOCUMENTS

| | | | | | |
|---|---|---|---|---|---|
| 3,932,798 | A | | 1/1976 | Chalmers et al. | 363/138 |
| 4,207,497 | A | | 6/1980 | Capewell et al. | 315/96 |
| 5,041,957 | A | | 8/1991 | Dhyanchand et al. | 363/43 |
| 5,270,913 | A | | 12/1993 | Limpaecher | 363/140 |
| 5,563,777 | A | | 10/1996 | Miki et al. | 363/37 |
| 5,796,214 | A | | 8/1998 | Nerone | 315/209 R |
| 5,874,810 | A | | 2/1999 | Nerone | 315/248 |
| 5,923,548 | A | * | 7/1999 | Kammiller | 363/56.03 |
| 6,057,652 | A | * | 5/2000 | Chen et al. | 315/307 |
| 6,111,363 | A | | 8/2000 | Nerone | 315/225 |
| 6,130,844 | A | | 10/2000 | Zerilli et al. | 365/189.11 |
| 6,339,298 | B1 | * | 1/2002 | Chen | 315/224 |
| 6,392,365 | B1 | | 5/2002 | Zhou et al. | 315/291 |
| 6,433,493 | B1 | | 8/2002 | Ilyes et al. | 315/291 |
| 6,525,488 | B2 | | 2/2003 | Nerone et al. | 315/209 R |

* cited by examiner

*Primary Examiner*—Don Wong
*Assistant Examiner*—Chuc Tran
(74) *Attorney, Agent, or Firm*—Fay, Sharpe, Fagan, Minnich & McKee, LLP

(57) ABSTRACT

In accordance with one aspect of the present application, a continuous mode voltage fed inverter includes a resistor starting network configured to start a charging of the inverter. A resonant feedback circuit is configured to generate an oscillating signal following the starting of operation of the circuit by the resistor starting network. A complementary switching network has a pair of complementary common source connected switches configured to receive the oscillation signal generated by the resonant feedback circuit, wherein the oscillation signal determines a switching rate of the complementary pair of switches. A clamping circuit is configured to maintain an inverter current in an inductive mode, wherein the inductive current lags voltage across the pair of complementary common source connected switches. A fold-back circuit is connected, in one embodiment, to the complementary switching network to provide a two-level clamping action. A first-level clamps the output voltage sufficient to permit a starting of the lamp. A second level of the two-level clamping arrangement of the fold-back circuit clamps the output voltage to protect the inverter from overheating when a lamp is removed from the circuit.

17 Claims, 2 Drawing Sheets

CONTINUOUS MODE VOLTAGE FED INVERTER

BACKGROUND OF THE INVENTION

The present application is directed to resonant inverter circuits, and more particularly to a voltage fed resonant inverter which operates continuously, from an open circuit condition at the output terminals to a short circuit condition.

Existing inverters include open- or short-circuit protection circuitry. One particular type of protection is through the use of pulse shutdown operations. In these designs, either the output voltage and/or the current that flows through resonant components or semiconductor switches is sensed to assist in the shutdown. When an open circuit situation occurs, such as when a lamp reaches its end-of-life, the maximum inverter current is detected, and the inverter is disabled or shut down before the components are overstressed. The use of the pulse shutdown technique will, however, cause an undesirable discontinuity of the output voltage. To accommodate new lamps which may not have recycling power, the inverter may also be periodically restarted. This periodic restarting results in an undesirable flicker as the lamp reaches its end of useful life. Voltage inverters which find particular benefit to protection in short circuit and/or open circuit situations are those being used in conjunction with discharge lamps including but not limited to linear fluorescent lamps (LFL), compact fluorescent lamps (CFL), and high intensity discharge lamps (HID).

SUMMARY OF THE INVENTION

In accordance with one aspect of the present application, a continuous mode voltage fed inverter includes a resistor starting network configured to start a charging of the inverter. A resonant feedback circuit is configured to generate an oscillating signal following the starting of operation of the circuit by the resistor starting network. A complementary switching network has a pair of complementary common source connected switches configured to receive the oscillation signal generated by the resonant feedback circuit, wherein the oscillation signal determines a switching rate of the complementary pair of switches. A clamping circuit is configured to maintain an inverter current in an inductive mode, wherein the inductive current lags voltage across the pair of complementary common source connected switches.

DETAILED DESCRIPTION OF THE INVENTION

Figure 1:
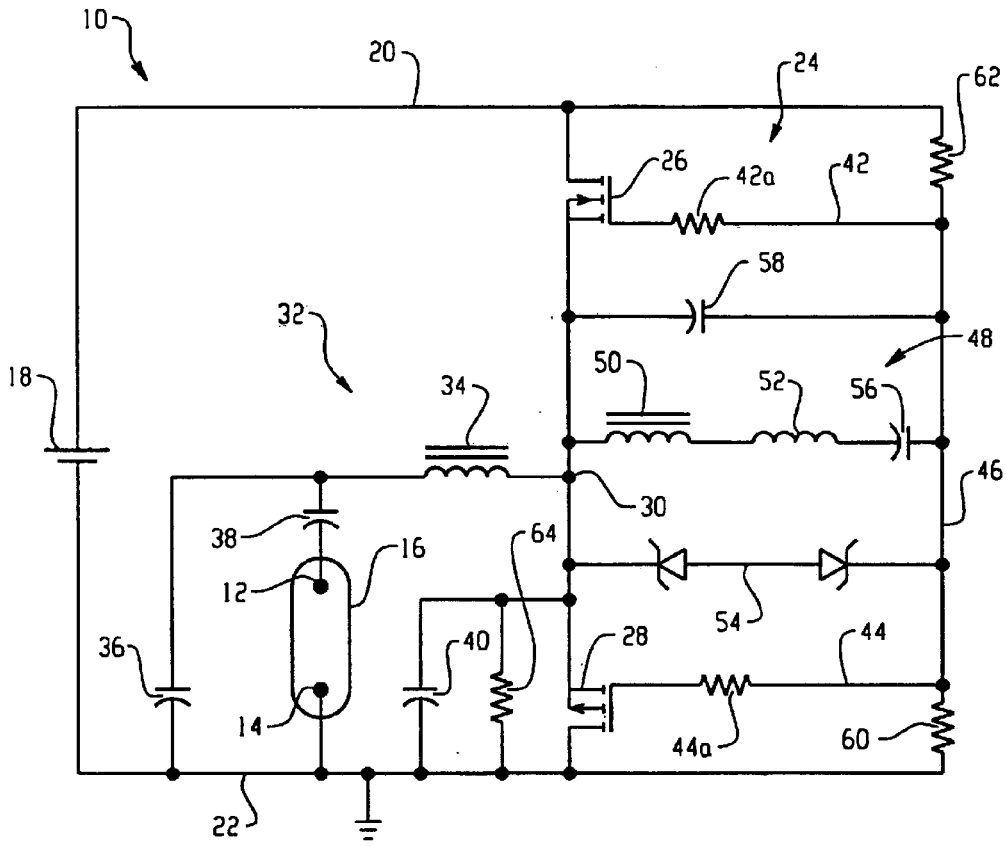
FIG. 1 illustrates an inverter circuit for driving a discharge lamp using a pair of complementary switches driven by a switch driving circuit.

FIG. 1 shows an inverter circuit 10 which may be altered in accordance with the concepts of the present application. The configuration of the circuit prior to the alteration, includes a pair of lamp connectors 12 and 14 configured to hold a lamp 16, such as a gas discharge lamp. Lamp 16 is powered from a d.c. bus voltage generated by source 18. The d.c. bus voltage exists between a bus conductor 20 and a reference conductor 22, and such voltage is converted to a.c., by d.c.-to-a.c. converter 24.

Switches 26 and 28, serially connected between conductors 20 and 22, are used in the conversion process. When the switches comprise n-channel and p-channel enhancement mode MOSFETs, respectively, the source electrodes of the switches are connected substantially directly together at a common node 30. The switches may comprise other devices having complementary conduction modes such as, but not limited to, pnp and npn Bipolar Junction Transistors. A resonant load circuit 32 includes a resonant inductor 34 and a resonant capacitor 36 for setting the frequency of resonant operation. Typically, resonant circuit 32 includes a d.c. blocking capacitor 38 and a so-called snubber capacitor 40.

Switches 26 and 28 cooperate to provide a.c. current from common node 30 to resonant inductor 34. The gate (or control) electrode lines 42 and 44 from the switches 26, 28 are substantially directly interconnected at a control node or conductor 46. Each control line having a respective resistance 42*a*, 44*a*. Gate drive circuitry, generally designated 48, is connected between control node 46 and common node 30, for implementing regenerative control of switches 26 and 28. Drive inductor 50 is mutually coupled to resonant inductor 34, to induce in inductor 50 a voltage proportional to the instantaneous rate of change of current in resonant load circuit 32. A second inductor 52 is serially connected to inductor 50, between common node 30 and control node 46. In some applications, it may be desirable to use a further inductor (not shown) connected between the left-shown node of inductor 52 and common node 30. A bi-directional voltage clamp 54 connected between nodes 30 and 46, such as the back-to-back Zener diodes shown, cooperates with second inductor 52 in such manner that the phase angle between the fundamental frequency component of voltage across resonant load circuit 32 (e.g., from node 30 to node 22) and the a.c. current in resonant inductor 34 approaches zero during lamp ignition. A capacitor 56 may be connected in the serial circuit of inductors 50 and 52, between node 30 and node 46, for purposes explained below.

A capacitor 58 is preferably provided between nodes 30 and 46 to predictably limit the rate of change of control voltage between such nodes. This beneficially assures, for instance, a dead time interval during switching of switches 26 and 28 wherein both switches are off between the times of either switch being turned on.

Serially connected resistors 60 and 62 cooperate with a resistor 64 for starting regenerative operation of gate drive circuit 48. In the starting process, capacitor 56 is charged, upon energizing of source 18, via resistors 60, 62 and 64. The voltage across capacitor 56 is initially zero, and, during the starting process, serial-connected inductors 50 and 52 act essentially as a short circuit, due to a relatively long time constant for charging of capacitor 56. With resistors 60–64 being of equal value, for instance, the voltage on common node 30, upon initial bus energizing, is approximately one-third of bus voltage 18. In this manner, capacitor 56 becomes increasingly charged, from right to left, until it reaches the threshold voltage of the gate-to-source voltage of upper switch 26 (e.g., 2–3 volts). At this point, the upper switch switches into its conduction mode, which then results in current being supplied by that switch to resonant load circuit 32. In turn, the resulting current in the resonant load circuit causes regenerative control of switches 26 and 28.

During steady state operation of ballast circuit 10, the voltage of common node 30 becomes approximately one-half of bus voltage 20. The voltage at node 46 also becomes approximately one-half bus voltage 20, so that capacitor 56 cannot again, during steady state operation, become charged so as to again create a starting pulse for turning on switch 26.

During steady state operation, the capacitive reactance of capacitor 56 is much larger than the inductive reactance of gate driving inductor 50 and second inductor 52, so that capacitor 56 does not interfere with operation of those inductors.

Resistor 64 may be alternatively placed in shunt across switch 26 (not shown) rather than across switch 28. The operation of the circuit is similar to that described above with respect to resistor 64 shunting switch 28. However, initially, common node 30 assumes a higher potential than node 46, so that capacitor 56 becomes charged from left to right. The results in an increasingly negative voltage between node 46 and node 30, which is effective for turning on switch 28.

Resistors 60 and 62 are both preferably used in the circuit of FIG. 1; however, the circuit functions substantially as intended with resistor 62 removed and using resistor 64. Starting might be somewhat slower and at a higher line voltage. The circuit also functions substantially as intended with resistor 60 removed and using an alternative resistor (not shown) to resistor 64 for shunting of switch 26.

During short circuit situations, the self-oscillating complementary switching circuit 10 of FIG. 1 will adjust the switching frequency and control to protect the circuit components from overheating. Nevertheless, circuit 10 has certain drawbacks. For example, during end-of-life situations, circuit voltage output will increase above operational levels, since no substantial limiting factor on the voltage output is provided. The increase in the voltage results in an increase in current through inductor 34. A limiting factor for the current is the resistance in the inductor transformer coils 34, 50, which is commonly a low value. Due to no substantial controlled limiting factors of the output voltage, the components including the switches, heat to temperatures which ultimately stress the components to a state which results in their destruction.

Figure 2:
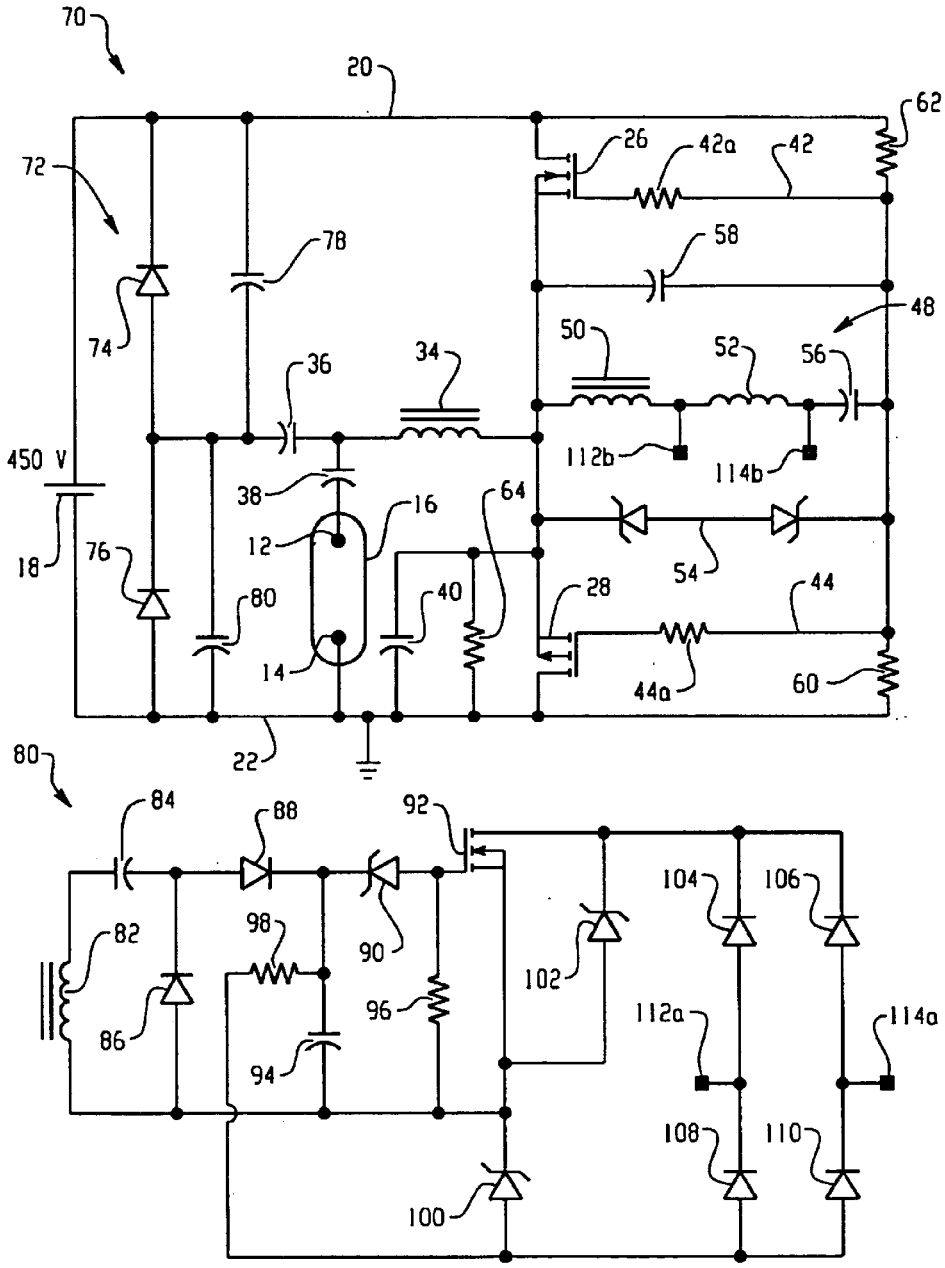
FIG. 2 depicts a continuous mode voltage fed inverter circuit according to the concepts of the present application.

Turning to FIG. 2, illustrated is an inverter circuit 70 in accordance with concepts of the present application, where inverter operation is maintained during an open circuit mode such as end-of-lamp-life conditions, without overstressing the inverter components, and still provide sufficient open circuit voltage to restart a new lamp. The topology of circuit 70 permits continuous operation from an open circuit condition at the output terminals to a short circuit condition. Components similar to that of FIG. 1, are provided with similar numbering.

Circuitry in addition to that used in circuit 10 of FIG. 1, includes a clamping circuit 72 having series connected diodes 74 and 76, and series clamping capacitors 78 and 80. While two clamping capacitors 78 and 80 are used in this embodiment, it is to be understood clamping circuit 72 may operate with a single clamping capacitor attached across one of the diodes 74 and 76. A benefit of using two capacitors is to distribute and limit the current to be carried by the capacitors, thereby permitting smaller valued components. The use of two capacitors 78, 80 also improves balance of the circuit.

A second structure added to inverter circuit 70 is a two-level clamp or fold-back circuit 80. This circuit adds a third inductive winding 82 in operative connection to inductive windings 34 and 50, where winding 82 is used to provide power to fold-back circuit 80. An LC network consisting of capacitor 84 and diode 86 is connected to the inductor winding 82, and together these components act as a charging circuit used to add a time delay to the operation of fold-back circuit 80. Diode 88 is forward biased to the time charging circuitry, and is biased opposite a Zener diode 90. One end of Zener diode 90 is connected to a gate of a switch transistor 92 (such as an enhancement mode MOSFET), a charge capacitor 94, a discharge resistor 96, and a negative bias resistor 98. Zener diodes 100 and 102 are connected to the source of transistor 92. A diode bridge formed by individual diodes 104–110 includes terminals 112*a* and 114*a* are arranged for placement of the diode bridge across inductor 52 via connection to terminals 112*b* and 114*b*.

Fold-back circuit 80 permits sufficient voltage to be applied across lamp 16 for starting, and also includes a time delay wherein, if the lamp has not started within the time delay, fold-back circuit 80 functions to cause the output voltage to drop to a level such that the components are not overstressed.

Fold-back circuit 80 is considered activated when transistor 92 is turned on. Prior to activation of fold-back circuit 80, Zener diodes 100 and 102 are used to clamp the output voltage, i.e. at nodes 12 and 14 of lamp), by clamping of the voltage across inductor 52. For example, if Zener diodes 100 and 102 are rated at 15 volts, then the clamping action across inductor 52 would be at 30 volts, when the fold-back circuit 80 is not active. When fold-back circuit 80 is activated, the voltage clamped across inductor 52 is half the previously clamped voltage, as Zener diode 102 is shorted out by transistor 92. It is to be appreciated, however, that use of fold-back circuit 80 is not efficient without an arrangement to clamp the resonant voltage in circuit 70. In this embodiment, the clamping is achieved by clamping arrangement 72, which includes diodes 74, 76 and capacitances 78, 80, as well as resonant capacitor 36. While the effects of fold-back circuit 80 are enhanced by inclusion of clamp circuit 72 into circuit 70, the use of clamp circuit alone may also provide certain benefits.

Without clamping circuitry 72, circuit 70 may undesirably operate in a capacitive mode. This mode of operation may occur, as intrinsic diodes in transistor switches 26 and 28 would begin conducting and transistors 26, 28 would become lossy, resulting in loss of circuit power. Clamping circuit 72 is, therefore, used to maintain the inverter current in an inductive mode. By this design, the current is maintained as lagging the voltages across switches 26, 28. It may also be viewed that by this arrangement, resonant current will lag the applied voltage created by the switching operations of switches 26, 28.

Clamping circuit 72 also limits the amount of power that is dissipated in Zener diodes 100 and 102, as the amount of power which can be provided to the gate circuit is lowered.

During a steady state mode of operation (i.e., where an operable lamp of proper value and type is connected and operating in the circuit) the resonant capacitance would include capacitors 36, 78 and 80, and clamping diodes 74 and 76 have no effect on circuit operation. It is when a lamp is removed from the system or during the starting operation that the clamping effect of diodes 74 and 76 come into play.

The following will describe operation of circuit 70 when a lamp 16 is in circuit 70 and the circuit is energized. In this situation, inverter 70 begins its self-oscillating operation as described previously. As the oscillations build up, the current through inductor 34 rises, and the voltage across lamp 16 increases. While this starting operation is occurring, fold-back circuit 80 is inactive, so the output voltage is clamped by the series combination of diodes 100 and 102. At this point, the voltage across the lamp may be approximately in the range of 1,000 to 1,300 peak volts in some embodiments, and more preferably 1,200 peak volts. At substantially the same time, diodes 74 and 76 are clamping to provide further limiting to the upper ranges of voltage applied to the lamp. Particularly, the components are selected such that there is sufficient voltage for lamp starting, but not to cause damage to the lamp or components of the circuit. This is the status of circuit 70 prior to lamp ignition.

Upon lamp ignition, the lamp will break down, and voltage across the lamp drops to an operating voltage, which may be between about 150 to 300 volts in some embodiments, and preferably approximately 200 volts peak. At this point, diodes 74 and 76 stop clamping, and circuit 70 enter steady state operation mode.

Attention is now directed to an open circuit operation where, for example, lamp 16 is not in the circuit 70. The first part of the starting operation after application of power is similar to that described above, where the oscillating operations begin building current and voltages within the circuit components, whereby a voltage is applied to the lamp connections 16*a*, 16*b*. However, at this point, if there is no lamp or the lamp does not light within a predetermined time delay (in one instance this may be about 1 second), the fold-back circuit 80 becomes activated.

Fold-back circuit 80 includes a charging circuit formed by inductor winding 82, capacitor 84 and diode 86, which is used to charge capacitor 94. When capacitor 94 charges up to approximately the threshold level of transistor 92, it will cause transistor 92 to turn on, shorting out Zener diode 102, causing the voltage across inductor 52 to be clamped only by Zener diode 100. This shorting operation causes the previous peak voltage output (e.g., 1,200 volts) to be decreased by about half (e.g., to about 600 volts peak max voltage output). Once fold-back circuit 80 reaches this second clamping mode, it may be maintained for an indefinite period, thereby preventing overheating of the circuit components.

As previously mentioned, fold-back circuit 80 does not immediately become active (i.e., turning on of transistor 92). To turn transistor 92 on, the charge from winding 82, capacitor 84 and diode 86 is transferred via diode 88 and Zener diode 90 to a charging capacitor 94. When charging capacitor 94 charges to the threshold voltage of transistor 92, transistor 92 turns on, shorting out diode 102, and the output voltage across inductor 52 is clamped by diode 100 alone, which, again, causes the peak output voltage to be decreased approximately in half (e.g., in one embodiment from about 1,200 volts peak to 600 volts peak).

The time necessary for capacitor 94 to reach a potential sufficient to turn on transistor 92 is controlled in part by the value of Zener diode 90. For example, the breakdown voltage of Zener diode 90 will, in part, determine the amount of voltage which needs to be sensed at winding 82 sufficient to break down Zener diode 90 and charge capacitor 94. In one scenario, if diode 90 has approximately a 10 volt Zener voltage and transistor 92 has a 1 volt threshold and diode 88 has approximately a forward voltage drop of about 1 volt, there would be approximately a 12 volt threshold necessary in order to begin charging capacitor 94. Therefore, there must be sufficient voltage on winding 82 before fold-back circuit 80 is able to be activated. The peak—peak voltage developed across winding 82 must, in this example, exceed 12 volts plus the voltage drop for diode 86 to activate circuit 80. It is to be understood these values and other values used herein are provided only as examples and are not intended to limit the scope of the description or claims.

When the output voltage of circuit 70 is at approximately 1,200 volts, there is sufficient voltage sensed by winding 82 (using an appropriate turns ratio between inductor 82 and inductor 34) to begin the charging process to eventually turn on fold-back circuit 80, when lamp 16 is not operable. However, in a case where normal operation occurs and the voltage across the load moves down to approximately 200 to 300 volts, fold-back circuit 80 is not supplied with sufficient voltage levels at winding 82 to become active, i.e., capacitor 94 will not receive sufficient voltage to charge up to the threshold of transistor 92.

Turning to another issue, the maximum value that capacitor 94 will charge up to is limited by an intrinsic breakdown diode of transistor 92, which is used to prevent the gate oxide of transistor 92 from being punctured. Transistor 92 is selected to have sufficiently high impedances so that the intrinsic diode may be used to clamp capacitor 94. In normal operation, the clamping value is not reached, but may be useful in transient situations. In one embodiment, this clamping might be at approximately 8 volts for capacitor 94.

Once transistor 92 is turned on and circuit 80 is active, the capacitive charge on capacitor 94 will drop down to a steady voltage charge, in one embodiment, of approximately 4 to 5 volts. Since, as assumed in the example discussion, transistor 92 has a threshold voltage of approximately 1 volt, there is a sufficient charge on capacitor 94 to keep transistor 92 in an on state, maintaining the output across inductor 52 at half its previously clamped value (i.e., 15 volts) and the open circuit output voltage of the circuit at approximately half of the starting voltage. The drop in charge on capacitor 94 is in reaction to a lowering of the sensed voltage across winding 82, due to the clamping effect of the fold-back circuit 80.

With attention to resistor 98, it is attached to an anode of Zener diode 100. When circuit 70 is operating in a normal mode, it is desirable to insure the transistor 92 is in an off state. Connection of resistor 98 to diode 100 provides a small negative bias voltage on the gate of transistor 92, to insure that transistor 92 maintains itself in an off state during normal operation. It is possible to place a negative bias across transistor 92, again due to the existence of the intrinsic diode of transistor 92. Placing a negative current through resistor 98 generates a small negative diode drop, which maintains transistor 92 in an off state during normal operation, and improves the noise immunity of the system.

Resistor 96 is a discharge resistor for capacitor 94. When power is shut off to circuit 70, and it is, for example, in the clamped or fold-back state, when the circuit is then turned back on, it is desirable to start the circuit in the high voltage mode and then be able to bring the circuit into a fold-back state if necessary. The use of resistor 96 provides a discharge path for capacitor 94, which acts to reset fold-back circuit 80.

This discharging will also be effective in a maintenance mode, i.e., when a relamping operation is taking place. In most instances, relamping occurs when power is being supplied to the circuit. Therefore, if the lamp is removed, for example, it means the fold-back circuit 80 has been activated, and the system is running in this lower clamped state, i.e., low open circuit mode. When the new lamp is inserted and the circuit has sufficient voltage to start the lamp, it is undesirable to have the fold-back circuit 80 activated while the lamp is running in a normal mode. When the lamp is plugged in, the voltage on the output goes down, causing the voltage across inductor 82 to go down, when there is not sufficient voltage in fold-back circuit 80 to maintain transistor 92 in an on state. In this situation, resistor 96 is used to discharge capacitor 94.

It is to be appreciated the foregoing designs or portions of the designs may be employed in a variety of lamps and systems. These systems include but are not limited to linear fluorescent lamps (LFL), compact fluorescent (CFL), high intensity discharge HID lamps, as well as other types discharge lamps. When employing the present concepts with a high intensity discharge lamp system, clamping circuit 72 may be provided alone without fold-back circuit 80, or an integrated circuit control may be used.

While the present system may be embodied in a number of different alternatives, with different values for components, in one embodiment implementing a half-bridge system such as is described herein, used with for example a 450 volt input, specific values for one particular implementation such as shown in FIG. 2 would include:

| Component Name/Number | Component Values |
|---|---|
| Switch 26 | 4N50 |
| Switch 28 | 3P50 |
| Inductor 34 | 3.5 mH |
| Capacitor 36 | 2.2 nF |
| Capacitor 38 | 6.8 nF |
| Capacitor 40 | 330 pF |
| Inductor 50 | 2.188 μH |
| Inductor 52 | 1500 μH |
| Diode Clamp 54 | 1N5240 |
| Capacitor 56 | 6.8 nF |
| Capacitor 58 | 1.5 nF |
| Resistors 60, 62 | 1M ohms |
| Diodes 74, 76 | 1N4148 |
| Capacitors 78, 80 | 680 pF |
| Inductor 82 | 9722 μH |
| Capacitor 84 | 150 pF |
| Diodes 86, 88 | 1N4148 |
| Zener Diode 90 | 1N5240 |
| Transistor 92 | FDV301 |
| Capacitor 94 | 100 μF |
| Resistor 96 | 100k ohms |
| Resistor 98 | 1M ohms |
| Diodes 100, 102 | 1N5245 |
| Diodes 104–110 | 1N4148 |

Other numbered components set forth in this application but not included in this listing may be determined is normal course. It is to be understood the provided values are given simply as examples and are not intended to be limiting of the claims. The invention has been described with reference to the preferred embodiments. Obviously, modifications and alterations will occur to others upon reading and understanding the preceding detailed description. It is intended that the invention is constructed as including all such modifications and alterations insofar as they come within the scope of the appended claims or the equivalents thereof.

What is claimed is:

1. A continuous mode voltage fed inverter comprising:

a resistor starting network connected to receive an input from an input voltage source, and charges the inverter using the input;

a resonant circuit configured to generate an oscillating signal following the starting of operation of the inverter by the resistor starting network;

a complementary switching network having a pair of complementary common source connected switches configured to receive the oscillation signal generated by the resonant circuit, wherein the oscillation signal determines a switching rate of the complementary pair of switches, the complementary switching network including a gate drive arrangement for regeneratively controlling the pair of complementary common source connected switches including, (i) a driving inductor mutually coupled to the resonant circuit in such manner that a voltage is induced therein which is proportional to the instantaneous rate of change of the inverter; said driving inductor being connected between a common node and a control node;

(ii) a second inductor serially connected to said driving inductor, with the serially connected driving and second inductors being connected between said common node and said control node; and (iii) a bidirectional voltage clamp connected between said common node and said control node for limiting positive and negative excursions of voltage of said control nodes with respect to said common node, and;

a clamping circuit configured to maintain an inverter current in an inductive mode, wherein the inductive current lags voltage across the pair of complementary common source connected switches.

2. The inverter according to claim 1 further including, a fold-back circuit in operative connection with the driving inductor and the second inductor, the fold-back circuit including two-level clamping action.

3. A continuous mode voltage fed inverter circuit comprising:

a resistor starting network connected to receive an input from an input voltage source, and charges the inverter using the input;

a resonant circuit configured to generate an oscillating sigal following the starting of operation of the inverter by the resistor starting network;

a complementary switching network having a pair of complementary common source connected switches configured to receive the oscillation sigal generated by the resonant circuit, wherein the oscillation signal determines a switching rate of the complementary pair of switches; and a clamping circuit that includes a pair of serially connected diodes connected to the voltage bus and the common bus and a clamping capacitor connected across one of the first diode and the second clamping diode, the clamping circuit being configured to maintain an inverter current in an inductive mode, wherein the inductive current lags voltage across the pair of complementary common source connected switches.

4. The inverter circuit according to claim 3, wherein the clamping circuit further includes a second clamping capacitor connected across the other of the first diode and the second diode.

5. The inverter circuit according to claim 1, further including a linear fluorescent lamp arranged to receive output of the inverter circuit.

6. The inverter circuit according to claim 1, further including a compact fluorescent lamp arranged to receive output of the inverter circuit.

7. The inverter circuit according to claim 1, further including a high intensity discharge lamp arranged to receive output of the inverter circuit.

8. The inverter according to claim 2, wherein a first level of the two-level clamping action of the fold-back circuit clamps a voltage across the second inductor sufficient to permit a starting of the lamp, and a second level of the two-level clamping arrangement of the fold-back circuit clamps a voltage across the second inductor to a value to protect the inverter from overheating when the lamp is removed.

9. The inverter according to claim 2, wherein the fold-back circuit includes a time delay circuit which delays activation of the fold-back circuit by a predetermined time delay following energization of the inverter.

10. An inverter circuit for operating a lamp, comprising:

(a) a resonant load circuit incorporating lamp connections and including a resonant inductance and a resonant capacitance;

(b) a d.c.-to-a.c. converter circuit coupled to said resonant load circuit for inducing an a.c. current in the resonant load circuit, said converter circuit including, (i) first and second switches serially connected between a bus conductor at a d.c. voltage and a reference conductor, and being connected together at a common node through which the a.c. load current flows, (ii) the first and second switches each comprising a control node and a reference node, the voltage between such nodes determining the conduction state of the associated switch, (iii) the respective control nodes of the first and second switches being interconnected, and (iv) the respective reference nodes of said first and second switches being connected together at said common node;

(c) a gate drive arrangement for regeneratively controlling the first and second switches, the arrangement including, (i) a driving inductor mutually coupled to the resonant inductor in such manner that a voltage is induced therein which is proportional to the instantaneous rate of change of the a.c. load current, the driving inductor being connected between the common node and the control nodes, (ii) a second inductor serially connected to the driving inductor, with the serially connected driving and second inductors being connected between the common node and the control nodes, and (iii) a bidirectional voltage clamp connected between the common node and the control nodes for limiting positive and negative excursions of voltage of the control nodes with respect to the common node;

(d) a clamping circuit configured to maintain the a.c. load current in an inductive mode, wherein the a.c. load current lags voltages across the first and second switches; and (e) a fold-back circuit in operative connection with the driving inductor and the second inductor, the fold-back circuit providing a two-level clamping action.

11. The inverter circuit according to claim 10, wherein the clamping circuit includes a pair of serially connected diodes connected to the voltage bus and the common bus and a clamping capacitor connected across one of the first diode and the second clamping diode.

12. The inverter circuit according to claim 11, wherein the clamping circuit further includes a second clamping capacitor connected across the other of the first diode and the second diode.

13. The inverter circuit according to claim 10, further including a linear fluorescent lamp arranged to receive the output of the inverter circuit.

14. The inverter circuit according to claim 10, further including a compact fluorescent lamp arranged to receive the output of the inverter circuit.

15. The inverter circuit according to claim 10, further including a high intensity discharge lamp arranged to receive the output of the inverter circuit.

16. The inverter according to claim 10, wherein a first level of the two-level clamping action of the fold-back circuit clamps a voltage across the second inductor sufficient to permit a starting of a lamp, and a second level of the two-level clamping action of the fold-back circuit clamps a voltage across the second inductor to a value to protect the invention from overheating when the lamp is removed.

17. The inverter according to claim 10, wherein the fold-back circuit includes a time delay circuit which delays activation of the fold-back circuit by a predetermined time following energization of the inverter.

* * * * *